US007890024B2

(12) United States Patent
Hirayama et al.

(10) Patent No.: US 7,890,024 B2
(45) Date of Patent: Feb. 15, 2011

(54) IMAGE HEATING APPARATUS WITH DETACHABLE UNIT URGING EXTERNAL HEATING MEMBER TO ROTATIONAL BODY

(75) Inventors: Taiya Hirayama, Toride (JP); Seiichiro Kameda, Abiko (JP); Masashi Sawada, Abiko (JP); Youichi Chikugo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 476 days.

(21) Appl. No.: 12/098,769

(22) Filed: Apr. 7, 2008

(65) Prior Publication Data

US 2008/0260425 A1 Oct. 23, 2008

(30) Foreign Application Priority Data

Apr. 20, 2007 (JP) ..... 2007-111165

(51) Int. Cl.
*G03G 15/20* (2006.01)

(52) U.S. Cl. ..... 399/122

(58) Field of Classification Search ..... 399/122, 399/107, 320, 321, 330, 328, 329, 335; 219/216; 430/124.1

See application file for complete search history.

(56) References Cited

U.S. PATENT DOCUMENTS 7,107,001 B2 9/2006 Kameda
7,251,425 B2 7/2007 Kameda ..... 399/68
7,262,391 B2 8/2007 Nishihara et al. ..... 219/619
7,372,008 B2 5/2008 Ohta et al. ..... 219/619
2003/0108370 A1* 6/2003 Chen et al. ..... 399/328
2007/0217838 A1* 9/2007 Yamana et al. ..... 399/328

FOREIGN PATENT DOCUMENTS

JP 10-149044 6/1998
JP 2004-37555 2/2004
JP 2005-258130 9/2005
JP 2005-316421 11/2005

* cited by examiner

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

The present invention provides an image heating apparatus which can easily attach and detach an external heating unit and easily perform a maintenance operation. The image heating apparatus has a fixing apparatus frame 62 which rotatably supports a fixing roller 40, a unit including a pressure spring 35 which urges an external heating roller 53 toward the fixing roller 40, a pressure guide shaft 37 which holds the pressure spring 35, and a pressure stay 38 which slidably supports the pressure guide shaft 37, a screw 61 which detachably fixes the unit to the fixing apparatus frame 62 via the pressure stay 38, and a pressure releasing arm 39 which releases the force of the pressure spring 35 acting on the screw 61 via the pressure stay 38 by sliding the pressure guide shaft 37 relative to the pressure stay 38.

8 Claims, 21 Drawing Sheets

IMAGE HEATING APPARATUS WITH DETACHABLE UNIT URGING EXTERNAL HEATING MEMBER TO ROTATIONAL BODY

BACKGROUND OF THE INVENTION

1. Field of the Invention

The present invention relates an image heating apparatus which heats a toner image on a recording material. The image heating apparatus includes a fixing apparatus which fixes a toner image onto a recording material and a gloss improving apparatus which heats a toner image fixed onto a recording material to improve the glossiness of the image. The image heating apparatus can be used for an image forming apparatus, such as a copying machine, a printer, and a facsimile, using electrophotography.

2. Description of the Related Art

Various kinds of image forming apparatuses have been known. Among them, the image forming apparatus using electrophotography which subjects a photosensitive member to image exposure with a laser beam and then develops it to obtain an image has been typically widespread. Such image forming apparatus has the advantages in high image quality and high speed and has been widely used as an output unit of a copying machine and a color laser beam printer.

A color image forming apparatus such as the copying machine and color laser beam printer is required to have high productivity (the number of printed sheets per unit time) on various sheets (recording materials) such as a thick sheet.

In order to increase high productivity, in particular, productivity on a sheet having a large basis weight in the image forming apparatus to which electrophotography is applied, the fixing speed of the fixing apparatus need to be increased. A large amount of heat is lost on the sheet having a large basis weight. The amount of heat necessary for fixing on the sheet having a large basis weight is much larger than that for fixing on a thin sheet. At present, the sheet having a large basis weight is subjected to fixing processing by decreasing the fixing speed.

Techniques which can improve the fixing speed of a color image have been already proposed in Japanese Patent Application Laid-Open (JP-A) Nos. 10-149044 and 2005-316421.

The fixing apparatus according to JP-A No. 10-149044 has a pair of fixing members rotatably disposed so as to be pressed into contact with each other, wherein nip portions formed by the pair of fixing members nip and convey a recording material formed with an unfixed image, thereby heating and fixing the unfixed image on the recording material. One or more external heating members can be brought into or out of contact with the pair of fixing members.

As shown in FIG. 10, in the fixing apparatus according to JP-A No. 2005-316421, external heating rollers 53 and 54 are pressed into contact with the surface of a fixing roller 40 to externally heat the fixing roller 40. Both end portions of the two external heating rollers 53 and 54 are rotatably supported by a support frame 30. The support frame 30 is mounted on a pressure arm 32 rotatable on a shaft 34. A compression spring 33 is mounted between the support frame 30 and the pressure arm 32. The pressure arm 32 is mounted so as to be pressed by the compression spring 35. The external heating rollers 53 and 54 are pressed into contact with the fixing roller 40. The external heating rollers 53 and 54 heat the fixing roller 40.

There are provided a mechanism configured to bring a plurality of external heating rollers into and out of contact with the surface of a member to be heated, and an adjusting unit which uniformly brings the plurality of external heating rollers into contact with the surface of the member to be heated.

The related art has the following problems. The fixing apparatuses according to JP-A Nos. 10-149044 and 2005-316421 realize high productivity on a thick sheet as the recoding material which is substantially equal to that on a thin sheet. It is contemplated that the amount of heat of the external heating rollers is increased to increase the amount of heat provided from the external heating rollers to the surface of the member to be heated. To provide a sufficient amount of heat from the external heating rollers to the fixing roller, roller nips which conduct the amount of heat are preferably increased.

The increased diameters of the external heating rollers to increase the roller nips result in making the fixing apparatus larger. Various members such as a cleaning unit and a temperature detecting unit are arranged around the fixing roller. The size of the external heating rollers is limited. When the plurality of external heating rollers are arranged as in JP-A No. 2005-316421, roller nips having a sufficient width are preferably formed by the external heating rollers having a small diameter.

To form large roller nips by the external heating rollers 53 and 54 having a small diameter in the heating and fixing apparatus having the external heating rollers of FIG. 10, the external heating rollers 53 and 54 need to be pressed onto the fixing roller 40 at a high contact pressure. Members having a high spring pressure are used as the springs 33 and 35.

When the external heating rollers 53 and 54 are pressed onto the fixing roller 40 at a high contact pressure, a new problem arises at the attachment of an external heating unit in an assembling process and at the detachment of the external heating unit in maintenance.

The operability is deteriorated because the member under a high spring pressure need to be detached. In the example of FIG. 10, in the state that the spring 35 having a high spring pressure is compressed, a member 70 which supports this is fixed to the fixing apparatus body by a screw. When the screw is unscrewed under the spring pressure of the spring 35, the screw is turned in the state that a pressing force is applied to the thread of the screw. Screw galling is easily caused.

An exclusive jig which compresses the springs 33 and 35 to detach the external heating unit is used. The exclusive jig is necessary for detaching the external heating unit, thereby needing to improve the operability.

SUMMARY OF THE INVENTION

The present invention provides an image heating apparatus which can easily perform the detaching operation of an urging unit which urges an external heating member.

The present invention provides an image heating apparatus having the followings. An image heating apparatus including: a first rotating member and a second rotating member configured and positioned to heat a toner image on a sheet at a nip portion therebetween; an external heating member configured and positioned to heat an external surface of the first rotating member by contacting the external surface of the first rotating member; a frame configured and positioned to rotatably support the first rotating member; an urging unit, detachably mounted to the frame by a screw, including an urging member configured and positioned to urge the external heating member toward the first rotating member; and a releasing mechanism configured and positioned to substantially release a force acting on the screw by the urging member to detach the urging unit from the frame.

Other objects of the present invention will become apparent by reading the following detailed description with reference to the attached drawings.

Further features of the present invention will become apparent from the following description of exemplary embodiments with reference to the attached drawings.

DESCRIPTION OF THE EMBODIMENTS

First Embodiment

An image forming apparatus using an image heating apparatus according to an embodiment of the present invention will be described.

[Image Forming Apparatus]

Figure 1:
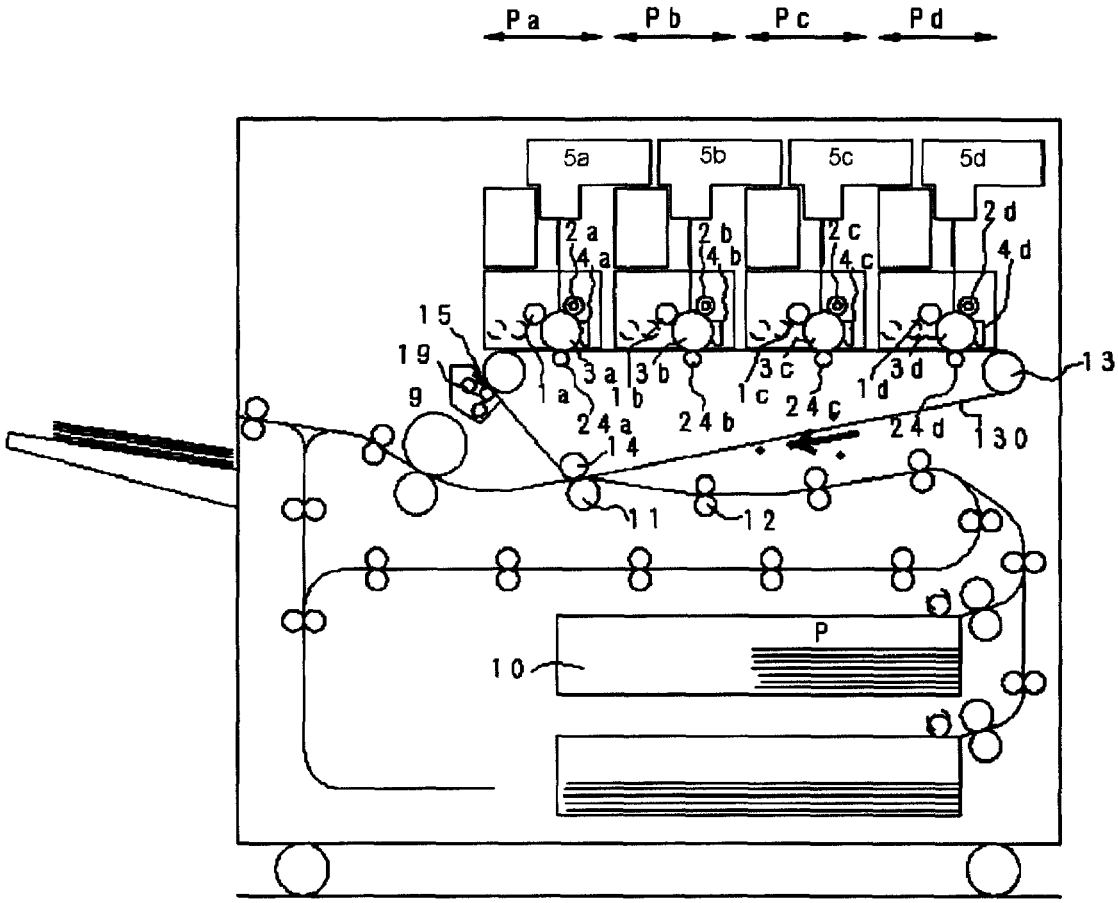
FIG. 1 is a schematic diagram of an image forming apparatus.

FIG. 1 is a schematic model diagram of an example of the image forming apparatus. The image forming apparatus in this example is a tandem-type color laser printer using a transfer-type electrophotograph process.

First, second, third, and fourth image forming portions Pa, Pb, Pc, and Pd are provided together in the image forming apparatus. Toner images of different colors are formed through latent image, development, and transfer processes.

The first to fourth image forming portions are image forming portions which form yellow, magenta, cyan, and black color images in that order and have the same structure except that the colors of the toners are different. The reference numerals a, b, c, and d indicated in FIG. 1 indicate members corresponding to the yellow, magenta, cyan, and black image forming portions. In the following description, when the colors need not be distinguished from each other, the reference numerals a, b, c, and d are omitted.

Each of the image forming portions P has an exclusive image bearing member, or, in this example, an electrophotographic photosensitive drum 3. A toner image of each of the colors is formed on the photosensitive drum 3. An intermediate transfer member (intermediate transfer belt) 130 is provided adjacent to the photosensitive drum 3. The toner image of each of the colors formed on the photosensitive drum 3 is primary-transferred onto the intermediate transfer member 130 and is then transferred onto a recording material P by a secondary transfer portion. The toner image is heated and pressed by a fixing apparatus 9 as the image heating apparatus and is then fixed onto the recording material P with the transferred toner image. The recording material P is discharged as a recorded image formation onto a discharge tray 6 outside the image forming apparatus.

A drum charger 2, a development device 1, a primary transfer charger 24 and a cleaner 4 are provided on the outer circumference of the photosensitive drum 3. A laser scanner 5 is provided in the upper portion of the image forming apparatus.

The photosensitive drum 3 is rotatably driven in a counterclockwise direction indicated by an arrow. The circumferential surface of the photosensitive drum 3 is uniformly primary-charged to a predetermined polarity and potential by the drum charger 2. The uniformly charged surface of the photosensitive drum 3 is subjected to scanning exposure with a laser beam modulated according to an image signal outputted from the laser scanner 5. A latent image according to the image signal is formed on the photosensitive drum 3. A light source device and a polygon mirror are provided in the laser scanner 5. The laser beam emitted from the light source device is scanned by rotating the polygon mirror. A light flux of the scanning light is deflected by a reflector and is then focused onto the bus line of the photosensitive drum 3 by an fθ lens for exposure L. The latent image according to the image signal is formed on the photosensitive drum 3.

The development device 1 is filled with a predetermined amount of cyan, magenta, yellow, and black toners as developers by a supply device, not illustrated. The development device 1 develops the latent image on the photosensitive drum 3 to visualize it as a cyan toner image, a magenta toner image, a yellow toner image, or a black toner image.

The intermediate transfer member 130 is suspended and extended between three parallel rollers 13, 14, and 15 and is rotatably driven at the same circumferential speed as that of the photosensitive drum 3 in a clockwise direction indicated by an arrow.

The first-color yellow toner image formed and born on a photosensitive drum 3*a* of the first image forming portion Pa passes through a nip portion between the photosensitive drum 3*a* and the intermediate transfer member 130. In the process, the first-color yellow toner image is primary-transferred onto the outer circumferential surface of the intermediate transfer member 130 by an electric field and a pressure formed by primary transfer bias applied to the intermediate transfer member 130.

In the same manner, the second-color magenta toner image, the third-color cyan toner image, and the fourth-color black toner image formed and born on photosensitive drums 3*b*, 3*c*, and 3*d* of the second, third, fourth image forming portions Pb, Pc, and Pd are sequentially superimposed and transferred onto the intermediate transfer member 130. A synthesized color toner image corresponding to a target color image is formed on the intermediate transfer member 130.

The intermediate transfer member 130 is nipped between a secondary transfer roller 11 and the roller 14 of the three rollers 13, 14, and 15 which suspend and extend the intermediate transfer member 130 so as to be pressed into contact therewith. A secondary transfer nip portion is formed between the secondary transfer roller 11 and the intermediate transfer member 130.

One recording material P is separated and fed from a sheet cassette 10 and is then standby for a predetermined time by a registration roller 12 as a recording material conveying unit. The recording material P is started to be conveyed with predetermined timing so as to be aligned with the image on the intermediate transfer member. The recording material passes through a guide before transfer and is then fed with predetermined timing to the secondary transfer nip portion as a contacting nip between the intermediate transfer member 130 and the secondary transfer roller 11. The synthesized color toner image superimposed and transferred onto the intermediate transfer member 130 is secondary-transferred onto the recording material P by secondary transfer bias applied from a bias power source.

The recording material P subjected to transfer of the synthesized color toner image by the secondary transfer nip portion is separated from the intermediate transfer member 130 and is then sequentially introduced into the fixing apparatus 9. Heat and pressure are applied to the recording material to fix the toner image.

The transfer remaining toner of the photosensitive drum 3 which has ended primary transfer is cleaned and removed by the cleaner 4 for forming the successive latent image.

The toner and other foreign substances remaining on the transfer belt 130 are wiped away by contacting a cleaning web (unwoven cloth) 19 onto the surface of the transfer belt 130.

As described above, the toners of multiple colors of the color image form two to four layers. The electrophotographic image forming apparatus capable of performing color image formation has a toner characteristic different from that of a monochrome image forming apparatus.

The toner is required to have good melting properties and color mixing properties for heat application. A sharp melt toner having a low softening point and a low melt viscosity is used. The use of the sharp melt toner can obtain a color copy in the wide color reproduction range of the copy.

Such sharp melt toner is manufactured by melt-kneading, grinding, and classifying a toner forming material such as a binding resin such as a polyester resin or a styrene-acrylic ester resin, a coloring agent (dye or sublime dye), and a charge controlling agent.

[Image Heating Apparatus]

The structure of the fixing apparatus 9 as the image heating apparatus will be described using FIG. 2. The image heating and fixing apparatus 9 of this embodiment has a fixing roller 40 as a first rotor and a pressure roller 41 as a second rotor which are a pair of fixing members rotatably arranged by being pressed into contact with each other at a total pressure of about 784 N (about 80 kg) by a pressing mechanism, not illustrated. The fixing roller 40 and the pressure roller 41 have in their inside halogen heaters 40*a* and 41*a* as heat generating units.

A fixing nip portion N is formed by pressing the fixing roller 40 and the pressure roller 41 into contact with each other. The fixing roller 40 and the pressure roller 41 are rotatably driven in directions indicated by arrows by a driving system, not illustrated. The fixing roller 40 and the pressure roller 41 nip and convey the recording material P, during which an image formed on the recording material is heated.

Thermistors 42*a* and 42*b* as temperature detecting units are brought into contact with the fixing roller 40 and the pressure roller 41. The thermistors 42*a* and 42*b* detect the temperatures of the fixing roller 40 and the pressure roller 41. A controller 43 controls the halogen heaters 40*a* and 41*a* based on the detection information and then controls the temperatures of the fixing roller 40 and the pressure roller 41. In this embodiment, both the temperatures of the fixing roller 40 and the pressure roller 41 are controlled so as to be maintained constant at about 165° C.

An unfixed image t transferred onto the recording material P and formed by the developer such as the sharp melt toner passes through the fixing nip portion N between the fixing roller 40 and the pressure roller 41 so as to be heated and pressed and is then fixed onto the recording material P.

The sharp melt color toner formed on the recording material P has a large affinity and a characteristic in which it is easily offset with respect to the fixing roller 40. It is necessary to exhibit high toner parting properties for a long time. An oil applying device 44 as a mold release agent applying unit and a cleaning device 45 which removes any oil and dirt on the fixing roller 40 are provided near the outer circumference of the fixing roller 40. A cleaning blade 46 which removes any oil and dirt on the pressure roller 41 is provided near the outer circumference of the pressure roller 41. The toner parting properties can be improved.

The oil applying device 44 applies dimethyl silicone oil 47*a* (KF96 manufactured by Shin-Etsu Chemical Co., Ltd., 300cs) in an oil pan 47 onto the fixing roller 40 via an oil drawing roller 48 and an oil applying roller 49. The oil applying device 44 applies the oil onto the outer circumferential surface of the fixing roller 40 by regulating the oil applying amount by an oil applying amount adjusting blade 50.

The oil applying roller 49 can be brought into or out of contact with the fixing roller 40 and applies the oil over the fixing roller developed surface length corresponding to a position of 5 mm from the front edge of the recording material P to a position of 5 mm from the rear edge thereof.

In this embodiment, the fixing roller 40 has an HTV (high-temperature vulcanizing type) silicone rubber layer 40*c* provided as a resilient layer on the outer circumference of a core metal 40*b* made of aluminum. An RTV (room-temperature vulcanizing type) silicone rubber layer 40*d* is provided as a heat-resistant resilient layer on the outer circumference of the HTV silicone rubber layer 40*c* and has a thickness of 3 mm and a diameter of 60 mm.

The pressure roller 41 of this embodiment has an HTV silicone rubber layer 41*c* having a thickness of 1 mm and provided as a resilient layer on the outer circumference of a core metal 41*b* made of aluminum. A fluorine resin layer 41*d* is provided on the outer circumference of the HTV silicone rubber layer 41*c* and has a diameter of 60 mm.

A combination of the fixing roller 40 and the pressure roller 41 can increase the toner parting properties from the sharp melt toner.

In recent years, a color copying machine has become widespread and is required to offer high speed and convenience at the same level as a monochrome copying machine. The color copying machine need to respond to various needs such as automatic duplex copy, or use of a postcard to a large-size sheet, use of a thin sheet to a thick sheet, and use of an OHP film and a back print film.

To fix a duplex image, the RTV or LTV (low-temperature vulcanizing type) silicone rubber having a high toner releasing effect is used for the outer layer, not only of the fixing roller 40, but also of the pressure roller 41. To satisfy the high speed properties of color fixing, the diameter of the roller is increased (e.g., a diameter of 80 mm) to increase the fixing nip portion N. To use a thick sheet, the fixing temperature is raised to improve the fixing properties.

Both the outer layer silicone rubber used for holding the toner parting properties and the lower layer silicone rubber for forming the fixing nip portion N so as to enclose the sharp melt toner essentially have a very high affinity for the silicone oil used. A large amount of silicone oil enters into the silicone rubber according to durability. The lowermost layer silicone rubber includes a large amount of silicone oil, resulting in separation between the boundary surfaces of the lowermost layer silicon rubber and the core metal at heating.

A copying machine which is required to provide a large quantity of copies at a high speed need to prevent the separation. A fluorine rubber is preferably stacked as an oil-resistant layer which cannot allow the silicone oil to be absorbed and passed between the lower layer silicone rubber and the outer layer silicone rubber on both the fixing roller 40 and the pressure roller 41.

(External Heating Structure)

In the fixing apparatus 9 of this embodiment, external heating members are brought into contact with the fixing roller 40 to externally heat the fixing roller 40. The external heating structure of the fixing roller 40 will be described.

Figure 2:
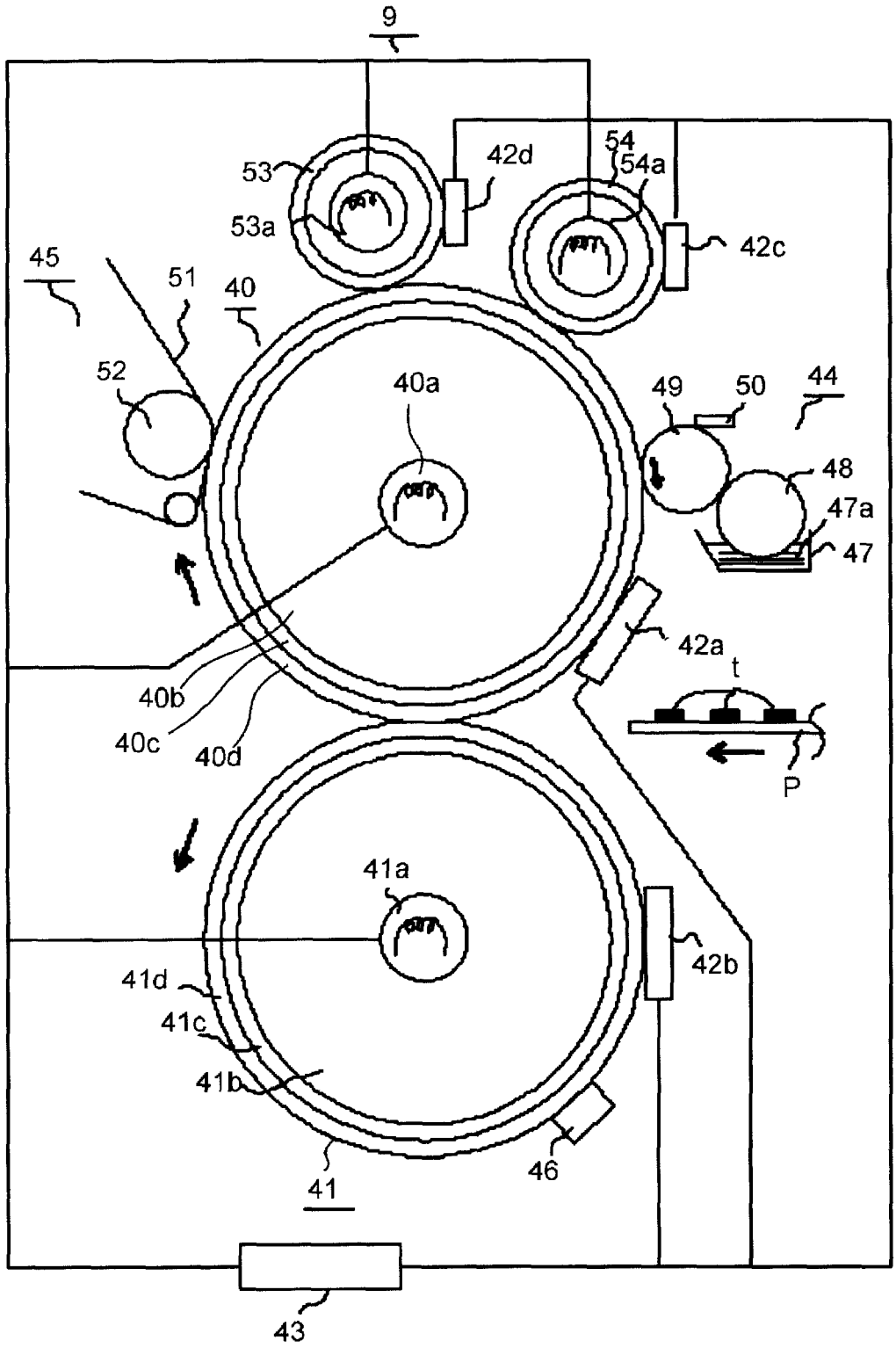
FIG. 2 is a schematic diagram of a fixing apparatus.

As shown in FIG. 2, the fixing apparatus 9 of this embodiment has first and second external heating rollers 53 and 54 as the external heating members provided on the outer circumferential surface of the fixing roller 40. The external heating rollers 53 and 54 are arranged in parallel on the upstream side and the downstream side in a rotating direction of the fixing roller 40 and can be brought into or out of contact with the fixing roller 40. The mechanism in which the external heating rollers 53 and 54 are brought into or out of contact with the fixing roller 40 will be described later.

The thermal conductivity of the rubber layer on the surface of the fixing roller is low with respect to the amount of heat lost on the recording material at fixing. A heat response from the fixing roller heater 40*a* is delayed. The external heating rollers 53 and 54 are provided for maintaining the surface temperature of the fixing roller 40 constant. To realize making the image heating apparatus fast, the two external heating rollers 53 and 54 are provided so as to increase the amount of heat provided from the external heating rollers 53 and 54 to the surface of the fixing roller 40.

The external heating rollers 53 and 54 have in their inside halogen heaters 53*a* and 54*a* and have outer circumferences provided by coating metal such as aluminum, iron, or stainless steel having a high thermal conductivity or rubber and resin having high to ner parting properties onto the metal surface. The external heating rollers 53 and 54 are held at both end portions by a thermal insulation bush having high thermal resistance.

The thermistors 42*a*, 42*b*, 42*c*, and 42*d* as the temperature detecting units are brought into contact with the fixing roller 40, the pressure roller 41, and the first and second external heating rollers 53 and 54. The thermistors 42*a*, 42*b*, 42*c*, and 42*d* detect the surface temperatures of the rollers 40, 41, 53, and 54. In the fixing operation, the controller 43 controls electric power supplied to the halogen heaters 40*a*, 41*a*, 53*a*, and 54*a* according to the temperature information to adjust the temperatures of the rollers 40, 41, 53, and 54.

As an example of the temperature adjustment, the temperature of the first external heating roller 53 is set to be higher than that of the fixing roller 40 and the pressure roller 41 as the pair of fixing members. The temperatures of the external heating rollers 53 and 54 are set to be 230° C. and the temperatures of the fixing roller 40 and the pressure roller 41 are set to be 165° C.

The controller 43 has a first control unit which controls the temperatures of the fixing roller 40 and the pressure roller 41 as the fixing members, and a second control unit which controls the temperatures of the first external heating roller 53 and the second external heating roller 54 as the plurality of external heating members. The target temperatures of the first external heating roller 53 and the second external heating roller 54 by the second control unit is higher than those of the fixing roller 40 and the pressure roller 41 by the first control unit.

The temperatures of the external heating rollers 53 and 54 are maintained higher than the temperature of the fixing roller 40. A response (heat sensitive precision) is good to the surface temperature of the fixing roller 40 lowered by the recording material. The external heating rollers 53 and 54 supply heat to the fixing roller 40. In this embodiment, the temperatures of the external heating rollers 53 and 54 are set to be 75° C. higher than those of the fixing roller 40 and the pressure roller 41.

(The Structure Which Brings the External Heating Members into Contact with the Fixing Roller)

The mechanism which brings the external heating rollers 53 and 54 into contact with the fixing roller 40 will be described.

Figure 3A:
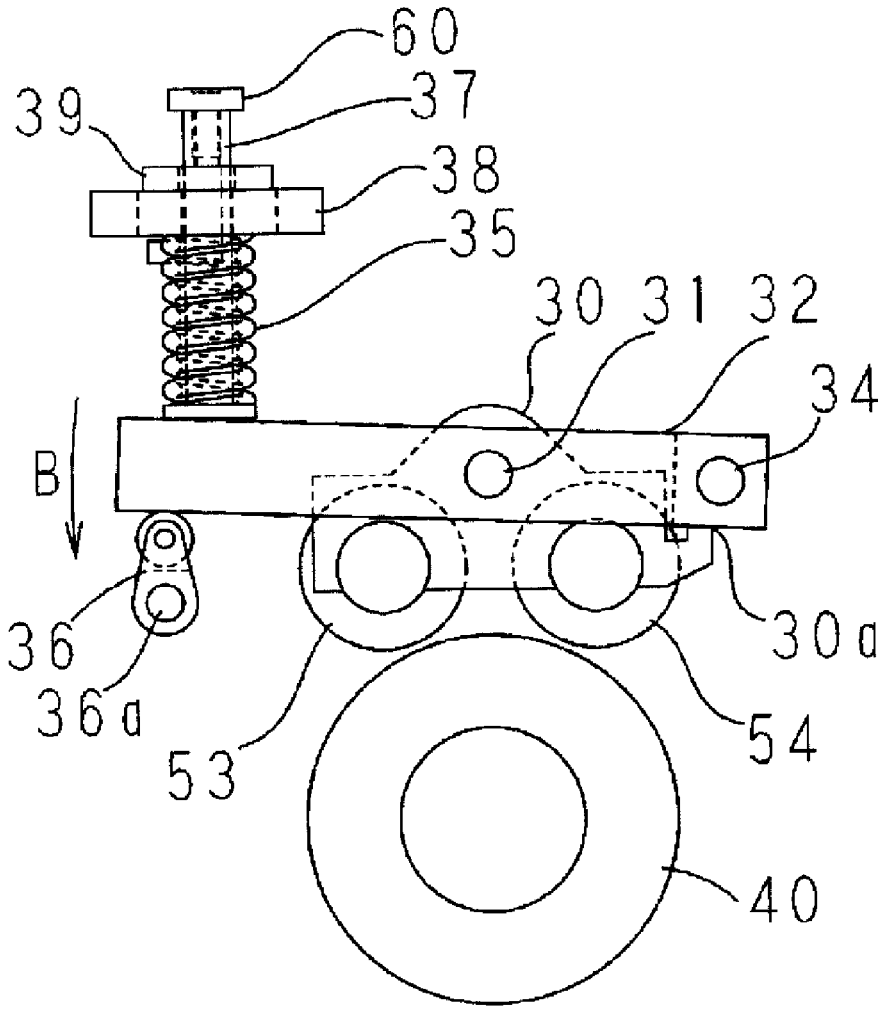
FIG. 3A is an explanatory view of the structure which brings external heating members into or out of contact with a fixing roller in the fixing apparatus according to a first embodiment and a cross-sectional view illustrating the state that the external heating members are brought out of contact with the fixing roller.
Figure 4A:
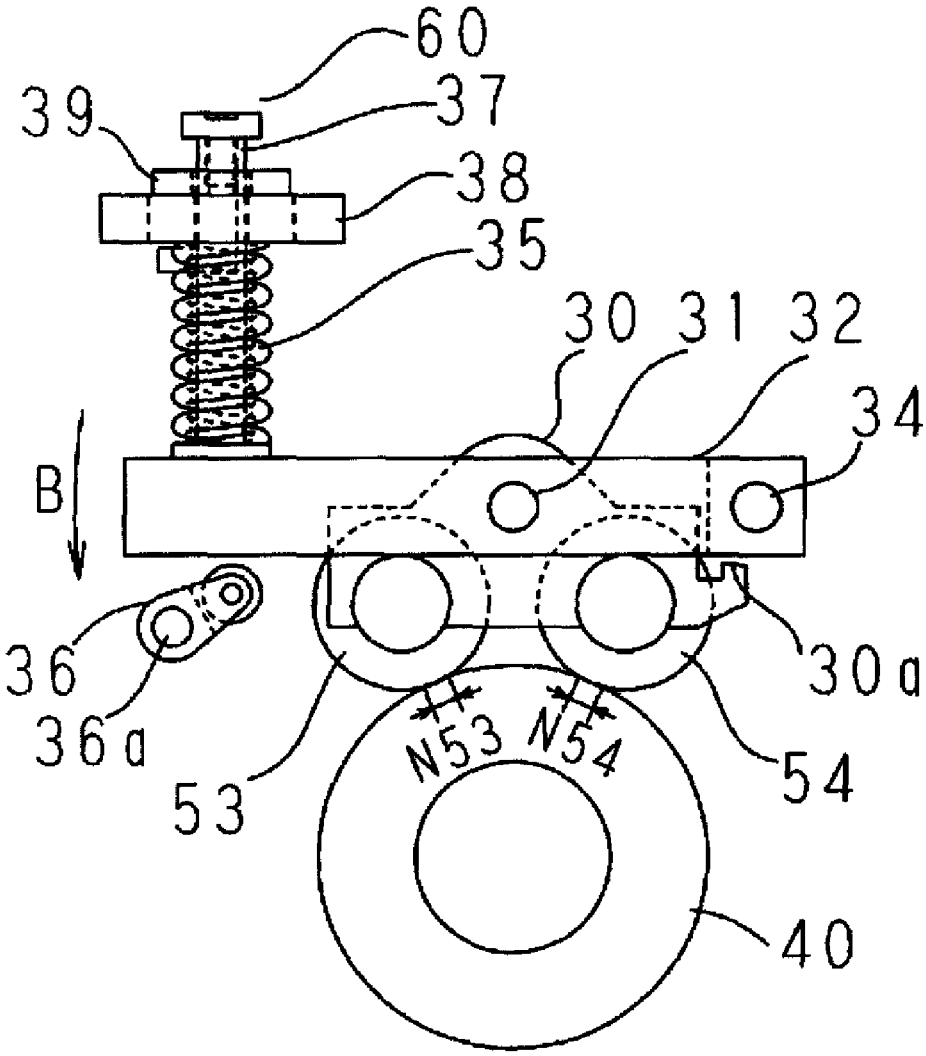
FIG. 4A is an explanatory view of the structure which brings external heating members into or out of contact with a fixing roller in the fixing apparatus according to the first embodiment and a cross-sectional view illustrating the state that the external heating members are brought into contact with the fixing roller.

As shown in FIGS. 3A and 4A, both end portions of the first and second external heating rollers 53 and 54 are rotatably bearing-supported on a support frame 30 via a thermal insulation bush and a bearing, not illustrated. Both end portions of the support frame 30 on the front side and the back side are rotatably supported on a pressure arm 32 by a support shaft 31. In the state of FIG. 3A in which the external heating rollers 53 and 54 are brought out of contact with the fixing roller 40, an abutting portion 30*a* provided in the support frame 30 abuts the pressure arm 32. The pressure arm 32 is rotatable on a support shaft 34 with respect to a fixing apparatus frame.

A pressing force which presses the external heating rollers 53 and 54 onto the fixing roller 40 is urged by a pressure spring 35 as an urging member. The member which urges the external heating rollers 53 and 54 toward the fixing roller 40 is structured as an external heating unit. The unit has the pressure spring 35 as the urging member which urges the external heating rollers 53 and 54 onto the fixing roller 40, a pressure guide shaft 37 as a holding member which holds the pressure spring 35, and a pressure stay 38 as a supporting portion which slidably supports the pressure guide shaft 37.

The pressure guide shaft 37 as the holding member which holds the pressure spring 35 and guides it in a pressing direction is mounted so as to be slid relative to the pressure stay 38 as the supporting member in an axial direction. The pressure spring 35 is inserted and held between the flange shape of the lower end of the pressure guide shaft 37 and the lower surface of the pressure stay 38.

The spring pressure of the pressure spring 35 is urged via the flange shape of the lower end of the pressure guide shaft 37 toward the free end of the pressure arm 32. The pressure arm 32 is urged by the spring pressure so as to be rotated on the support shaft 34 in a direction indicated by an arrow B.

A screw 60 having a head having an outer diameter larger than that of the pressure guide shaft 37 is attached to the upper end of the pressure guide shaft 37 so as to prevent the pressure guide shaft 37 and the pressure spring 35 falling off the pressure stay 38.

A pressure releasing arm 39 is attached between the upper surface of the pressure stay 38 and the screw 60. The detail of the pressure releasing arm 39 will be described later.

Both end portions of the pressure stay 38 are attached to frames 62 and 63 by screws 61 to support the reaction force of the pressure spring 35.

(The Structure Which Brings the External Heating Members Out of Contact with the Fixing Roller)

The mechanism which brings the first and second external heating rollers 53 and 54 as the external heating members out of contact with the fixing roller 40 will be described using FIGS. 3A and 3B.

As described above, the pressure arm 32 is rotatable on the support shaft 34. A detaching arm 36 as a mechanism configured to bring the external heating rollers 53 and 54 into and out of contact with the fixing roller 40 is arranged near the free end portion of the pressure arm 32. The detaching arm 36 is mounted so as to be rotatable on a rotating shaft 36*a* and is rotated by a rotating unit, not illustrated, controlled by the controller 43 (FIG. 2). The rotating unit is structured using a clutch and a motor as well known techniques.

Figure 3B:
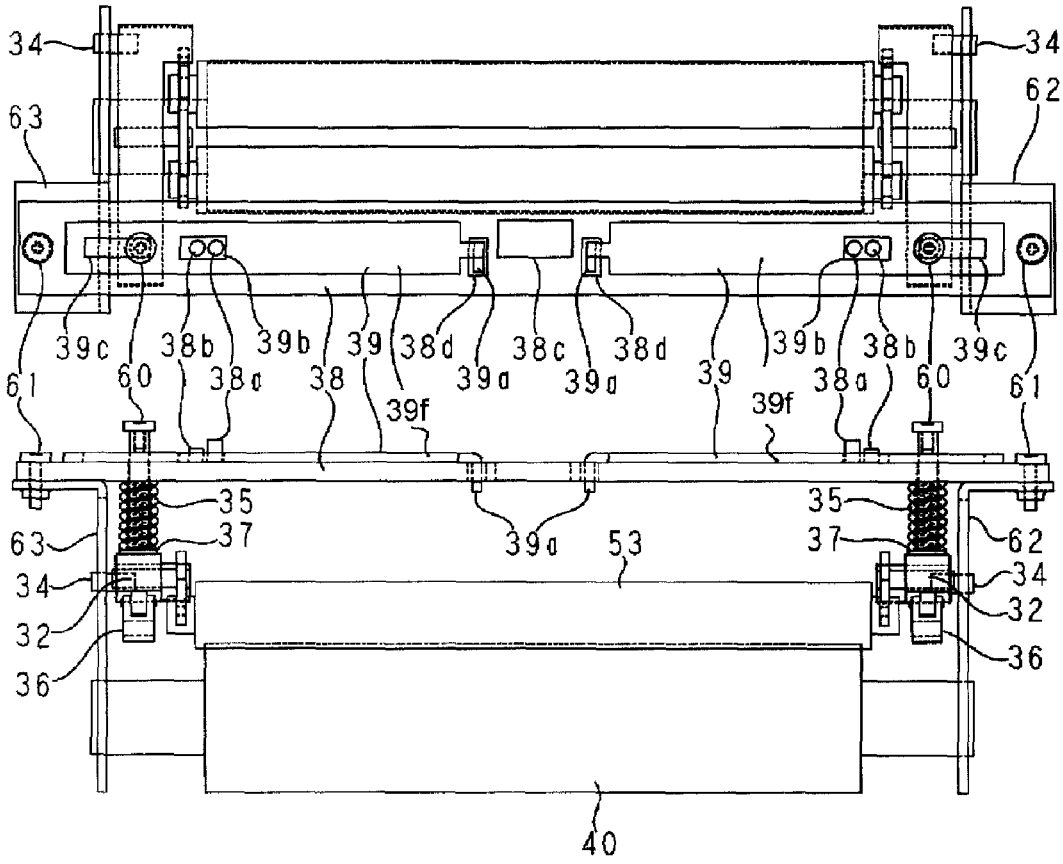
FIG. 3B is an explanatory view of the structure which brings external heating members into or out of contact with a fixing roller in the fixing apparatus according to a first embodiment and a top view and a front view illustrating the state that the external heating members are brought out of contact with the fixing roller.
Figure 4B:
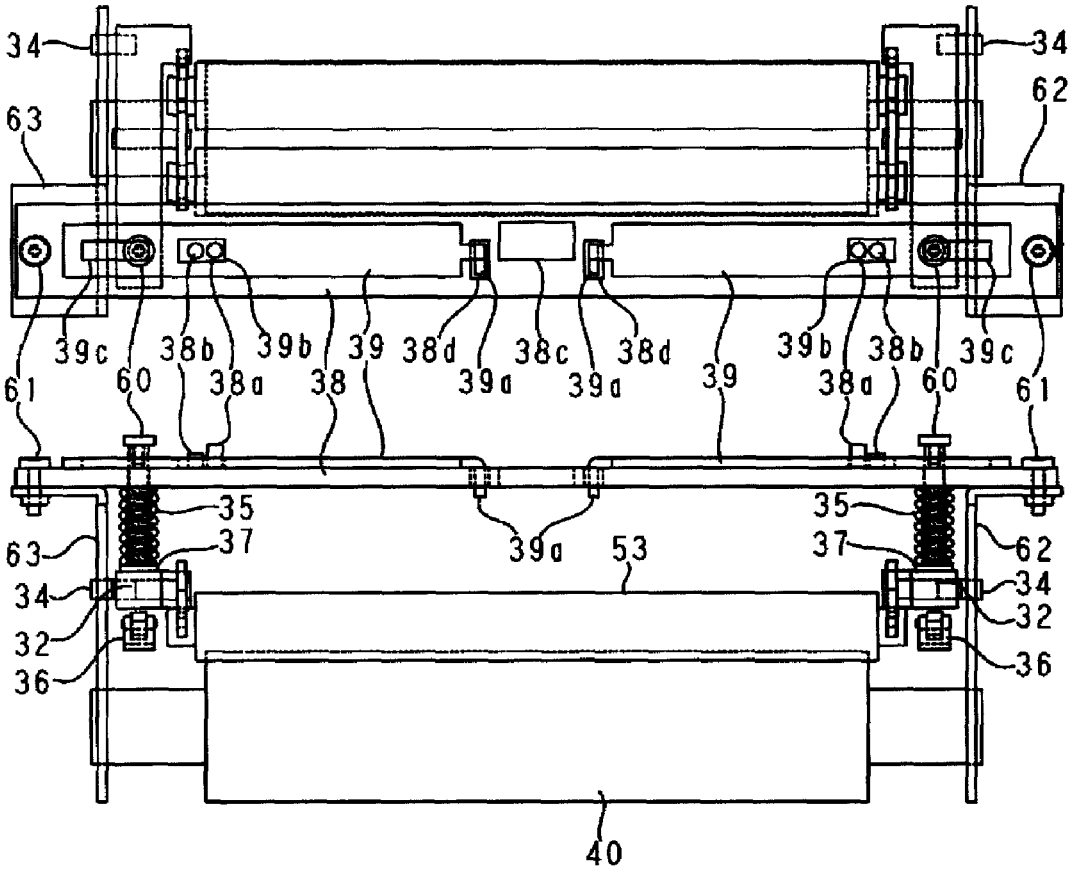
FIG. 4B is an explanatory view of the structure which brings external heating members into or out of contact with a fixing roller in the fixing apparatus according to the first embodiment and a top view and a front view illustrating the state that the external heating members are brought into contact with the fixing roller.

As shown in FIGS. 3A and 3B, when the detaching arm 36 pushes up the pressure arm 32, the first and second external heating rollers 53 and 54 are brought out of contact with the fixing roller 40. As shown in FIGS. 4A and 4B, when the detaching arm 36 is rotated and is then brought out of contact with the pressure arm 32, the first and second external heating rollers 53 and 54 are brought into contact with the fixing roller 40.

In this embodiment, the external heating rollers 53 and 54 are brought into contact with the fixing roller 40 by a total pressure of about 392N (about 40 kgf) and is then rotated by following rotation of the fixing roller 40. Contact nips (contact lengths) N53 and N54 between the external heating rollers 53 and 54 and the fixing roller 40 illustrated in FIG. 4A are about 5 mm respectively. The two rollers 53 and 54 can obtain a total nip of 10 mm.

(The Pressure Releasing Mechanism of the External heating Members)

The structure of a releasing unit which releases the pressure of the external heating members and the attaching and detaching structure of the external heating unit using the same will be described using FIGS. 5A, 5B, 5C, 5D, 5E, 6A, 6B, 6C, and 6D.

The external heating unit is attached such that the pressure stay 38 is detachably fixed to the fixing apparatus frames 62 and 63 as frames which rotatably support the fixing roller 40 by the screws 61 as fixing members. To detach the external heating unit, the pressure stay 38 need to be detached from the fixing apparatus frames 62 and 63.

The spring pressure of the pressure spring 35 acts on the pressure stay 38. When the pressure stay 38 is detached in this state, the screw 61 is turned in the state that the spring pressure acts on the screw 61 with the result that screw galling is likely to occur. In this embodiment, there is provided a releasing mechanism which releases the force of the pressure spring 35 acting on the screw 61 as the fixing member via the pressure stay 38 by sliding the pressure guide shaft 37 as the holding member relative to the pressure stay 38 as the supporting member. In the state that the spring pressure does not act on the screw 61, the attaching and detaching operation of the pressure stay 38 can be performed.

The pressure releasing arm 39 which is an arm member (lever member) rotatable on a supporting point portion is mounted on the upper surface of the pressure stay 38. The pressure releasing arm 39 is mounted in the state that the guide shaft 37 penetrates through a slot 39*c* as a coupling portion. The slot 39*c* has a dimension in a shorter direction larger than the outer diameter of the guide shaft 37 and smaller than the outer diameter of the head of the screw 60. The pressure releasing arm 39 is supported so as to be slidable in a longitudinal direction in the coupling portion without falling off the pressure stay 38. The pressure releasing arm 39 has at its edge an engaging portion 39*a* which is a hook portion (lock portion) engageable with the pressure stay 38. The engaging portion 39*a* is formed to be bent in L shape so as to be hooked through an engaging hole portion 38*c* of the pressure stay 38.

A first supporting point member (a first supporting point portion and a first protruding portion) 38*a* and a second supporting point member (a second supporting point portion and a second protruding portion) 38*b* are provided on the upper surface of the pressure stay 38 as the supporting member. The pressure releasing arm has a slot 39*b*. In the normal operation for image formation (at pressure unreleasing by the pressure releasing arm 39), the pressure releasing arm 39 is arranged in the state that the first supporting point member 38*a* and the second supporting point member 38*b* penetrate through the slot 39*b*. The second supporting point member 38*b* has the amount of protrusion smaller than that of the first supporting point member 38*a*.

The engaging hole portion 38*c* formed in the pressure stay 38 can insert the engaging portion 39*a* thereinto such that an arm portion 39*f* (see FIG. 3B) is substantially parallel with the pressure stay 38 at the pressure unreleasing of the pressure releasing arm 39. The pressure releasing arm 39 at the pressure unreleasing is substantially integral with the pressure stay 38. Any special mounting space for mounting the pressure releasing arm 39 need not be provided.

Figure 5A:
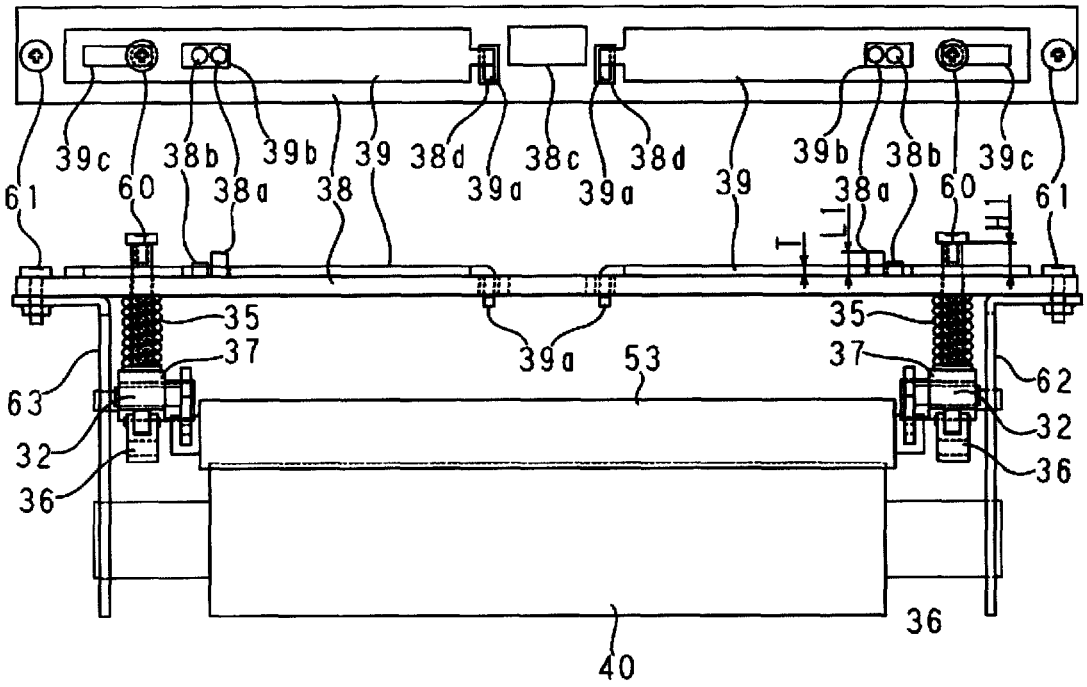
FIG. 5A is an explanatory view of a pressure releasing method of external heating members in the state that the external heating members are brought out of contact with a fixing roller in the fixing apparatus according to the first embodiment and an explanatory view illustrating the state before a pressure releasing arm is operated.

In this example, when the image forming operation is ended, the external heating rollers 53 and 54 are brought out of contact with the fixing roller 40. When the external heating unit is detached for maintenance, as shown in FIG. 5A, the detaching arm 36 pushes up the pressure arm 32 so that the guide shaft 37 is lifted. When the amount of protrusion of the guide shaft 37 from the upper surface of the pressure stay 38 is H1 and the thickness of the pressure releasing arm 39 is T, a height L1 of the first supporting point member 38*a* is $$L1 \approx H1 - T$$

(≈: nearly equal)

Figure 5B:
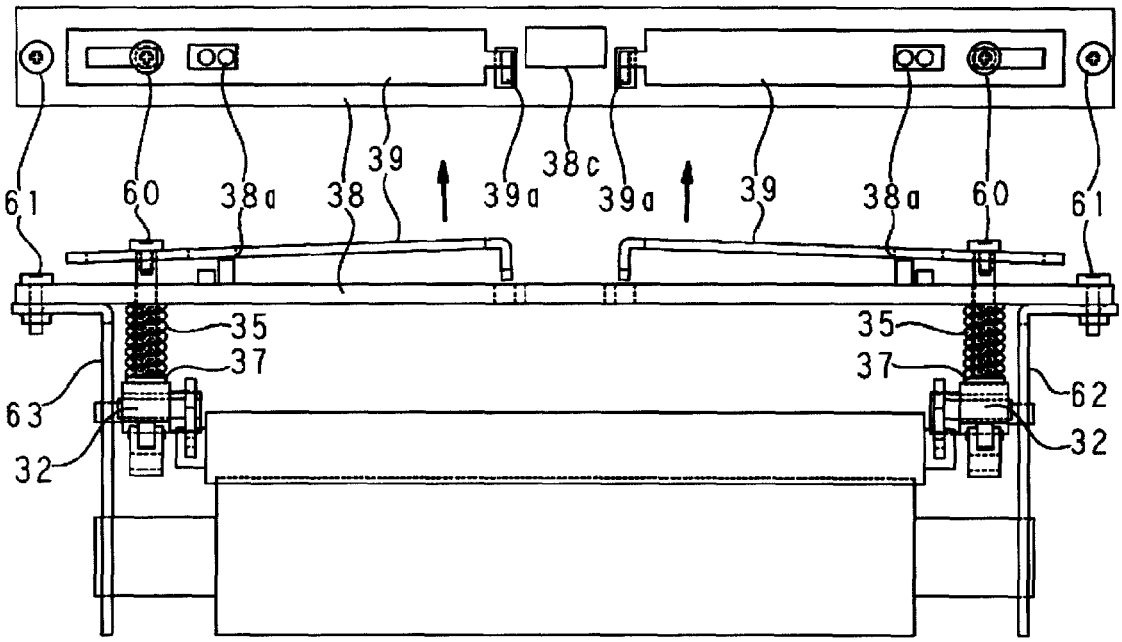
FIG. 5B is an explanatory view of a pressure releasing method of external heating members in the state that the external heating members are brought out of contact with a fixing roller in the fixing apparatus according to the first embodiment and an explanatory view illustrating the state that a pressure releasing arm is lifted.
Figure 5C:
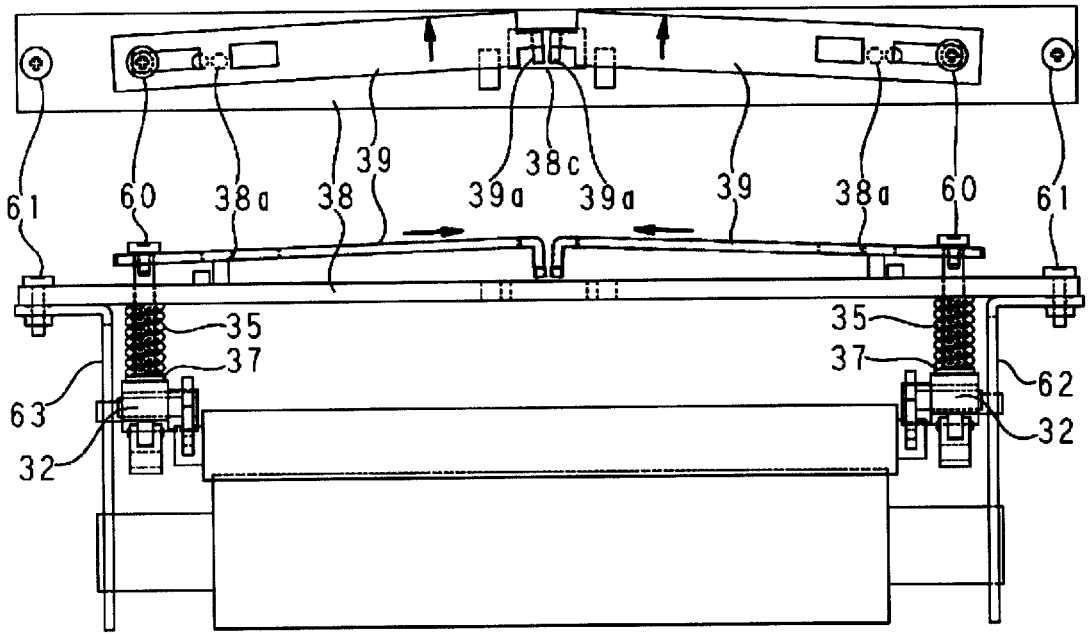
FIG. 5C is an explanatory view of a pressure releasing method of external heating members in the state that the external heating members are brought out of contact with a fixing roller in the fixing apparatus according to the first embodiment and an explanatory view illustrating the state that a pressure releasing arm is slid.

When the pressure releasing arm 39 is lifted and its upper surface abuts the head of the screw 60 at the edge of the guide shaft 37, the slot 39*b* of the pressure releasing arm 39 passes out through the first supporting point member 38*a*. As illustrated in FIG. 5B, the pressure releasing arm 39 is lifted above the height L1 of the first supporting point member 38*a*. As illustrated in FIG. 5C, the pressure releasing arm 39 can be slid so as to be substantially parallel with a longitudinal direction.

Figure 5D:
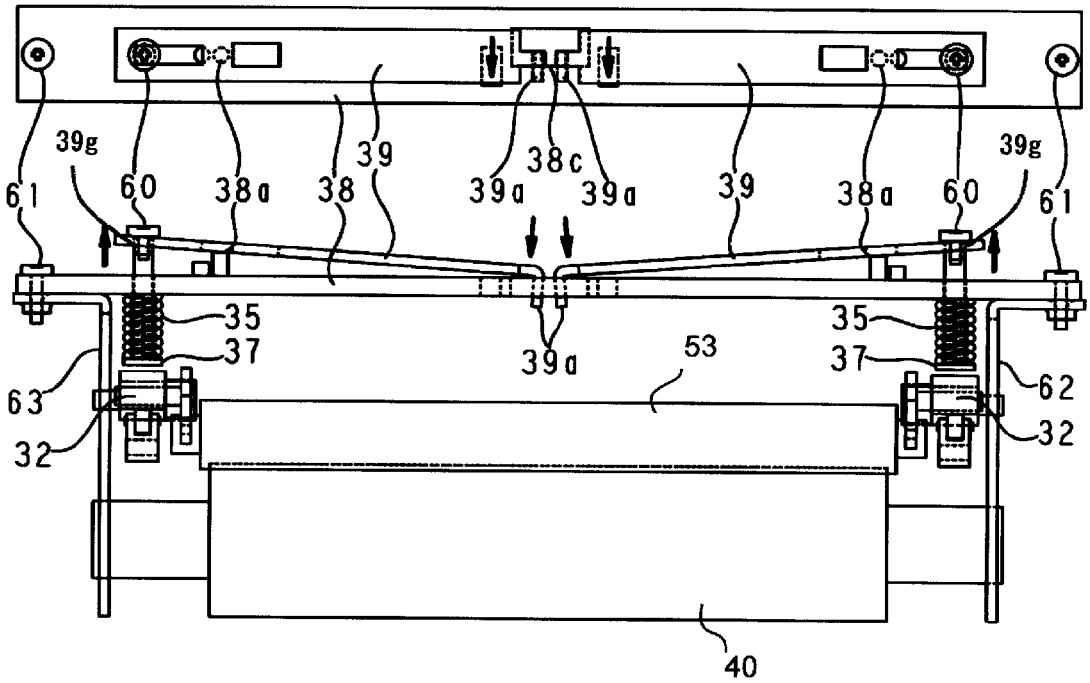
FIG. 5D is an explanatory view of a pressure releasing method of external heating members in the state that the external heating members are brought out of contact with a fixing roller in the fixing apparatus according to the first embodiment and an explanatory view illustrating the state that a pressure releasing arm is operated to lift a pressure guide shaft.

As illustrated in FIG. 5C, the pressure releasing arm 39 is moved onto the first supporting point member 38*a*. As illustrated in FIG. 5D, the end portion of the engaging portion 39*a* is depressed. The first supporting point member 38*a* becomes the supporting point. The other end which is an acting portion 39*g* (FIG. 5D) acting on the pressure guide shaft 37 is lifted in the state that it abuts the screw 60. The guide shaft 37 is lifted.

The engaging portion 39*a* of the pressure releasing arm 39 is hooked through the engaging hole portion 38*c* of the pressure stay 38 so as to hold the state that the guide shaft 37 is lifted (slide state). In the pressure releasing arm 39, the distance from the first supporting point member 38*a* to the engaging portion 39*a* is sufficiently longer than the distance from the first supporting point member 38*a* to the acting portion 39*g*. The operation for depressing the engaging portion 39*a* against the spring pressure of the pressure spring 35 can be easily performed without using any tools.

In this embodiment, the distance from the first supporting point member 38*a* to the acting portion 39*g* of the pressure releasing arm 39 is set to be 22 mm whereas the distance from the first supporting point member 38*a* to the engaging portion 39*a* is set to be 170 mm. Even if the spring pressure of the pressure spring 35 is large, a force which depresses the engaging portion 39*a* on the first supporting point member 38*a* can be small.

The pressure spring 35 is compressed. The lower surface of the guide shaft 37 is brought out of contact with the pressure arm 32. The spring pressure of the pressure spring 35 acts between a pressure spring holding portion 37*a* (FIG. 5E) provided in flange shape in the lower portion of the guide shaft 37 and the pressure stay 38. The spring pressure which depresses the guide shaft 37 is supported by the releasing arm 39 via the screw 60 and is supported by the pressure stay 38 in the engaging portion 39*a*. The spring pressure does not act on the screw 61. In this state, the screw 61 can be easily loosened without causing screw galling.

Figure 5E:
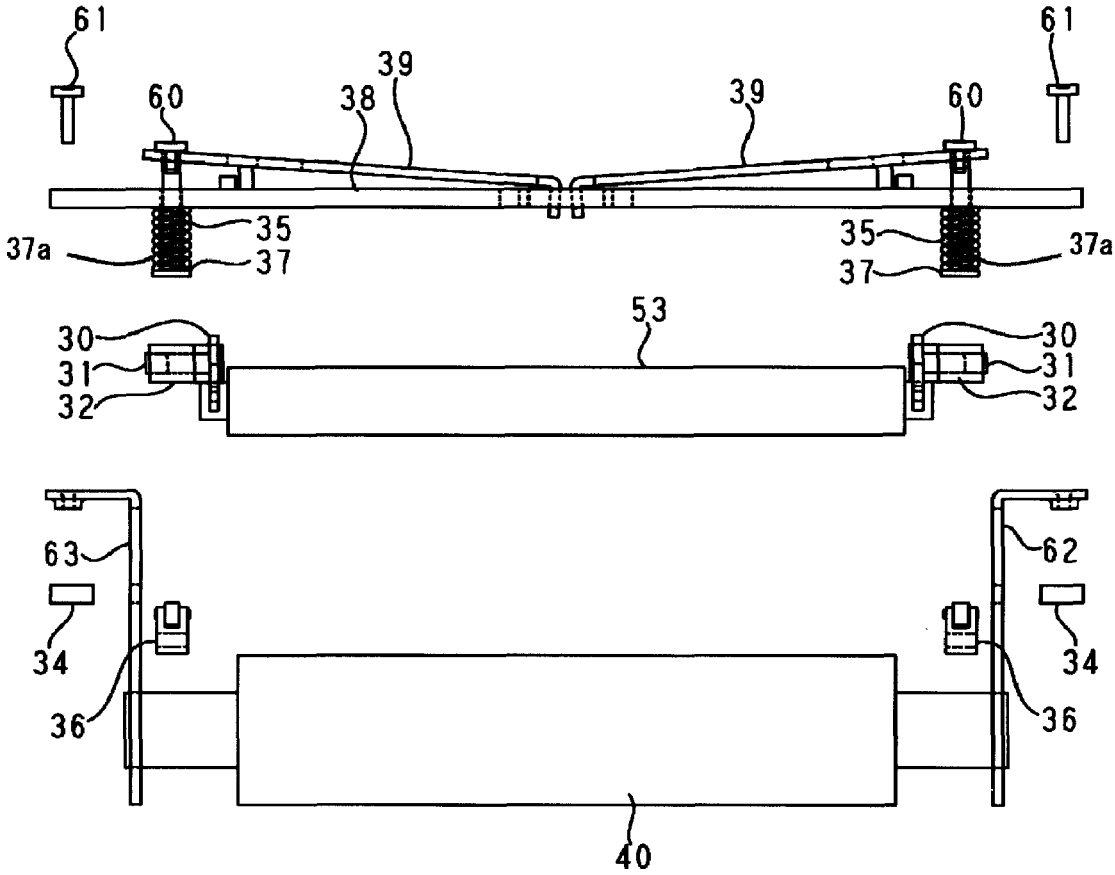
FIG. 5E is an explanatory view of a pressure releasing method of external heating members in the state that the external heating members are brought out of contact with a fixing roller in the fixing apparatus according to the first embodiment and an explanatory view illustrating the state that a screw is unscrewed to detach an external heating unit.

When the screw 61 is unscrewed, as illustrated in FIG. 5E, the pressure stay 38, the releasing arm 39, the guide shaft 37, the pressure spring 35, and the screw 60 can be integrally detached from the fixing apparatus. When the support shaft 34 is removed, the external heating rollers 53 and 54, the support frame 30, the support shaft 31, and the pressure arm 32 can be detached as the integral external heating unit.

Figure 6A:
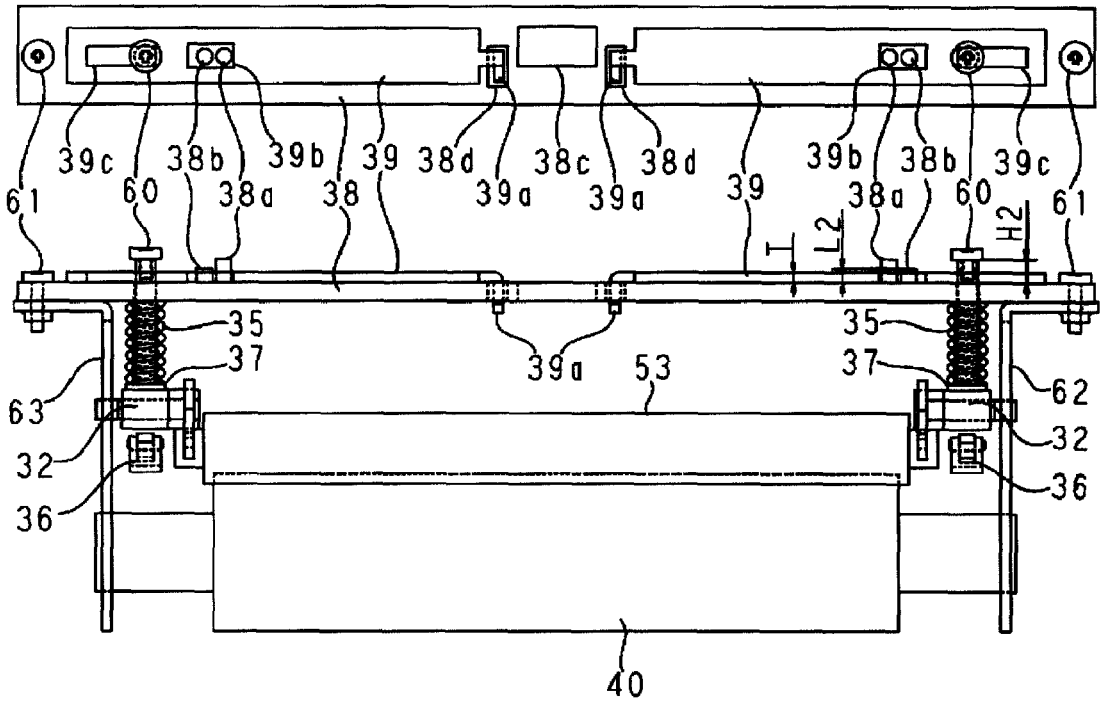
FIG. 6A is an explanatory view of a pressure releasing method of external heating members in the state that the external heating members are brought into contact with a fixing roller in the fixing apparatus according to the first embodiment and an explanatory view illustrating the state before a pressure releasing arm is operated.

When the external heating unit is detached due to some cause in the state that the external heating rollers 53 and 54 are pressed onto the fixing roller 40, as illustrated in FIG. 6A, the detaching arm 36 is brought out of contact with the pressure arm 32. The guide shaft 37 is lower than that in the state illustrated in FIG. 5A. In this case, the distance between the pressure stay and the screw 60 is smaller than that in the state illustrated in FIG. 5A. The pressure releasing arm 39 cannot be moved onto the first supporting point member 38*a*. The second supporting point member 38*b* having the amount of protrusion smaller than that of the first supporting point member 38*a* is used to perform the pressure releasing operation.

When the amount of protrusion of the guide shaft 37 from the upper surface of the pressure stay 38 is H2 and the thickness of the pressure releasing arm 39 is T, a height L2 of the second supporting point member 38*b* is $$L2 \approx H2 - T$$

Figure 6B:
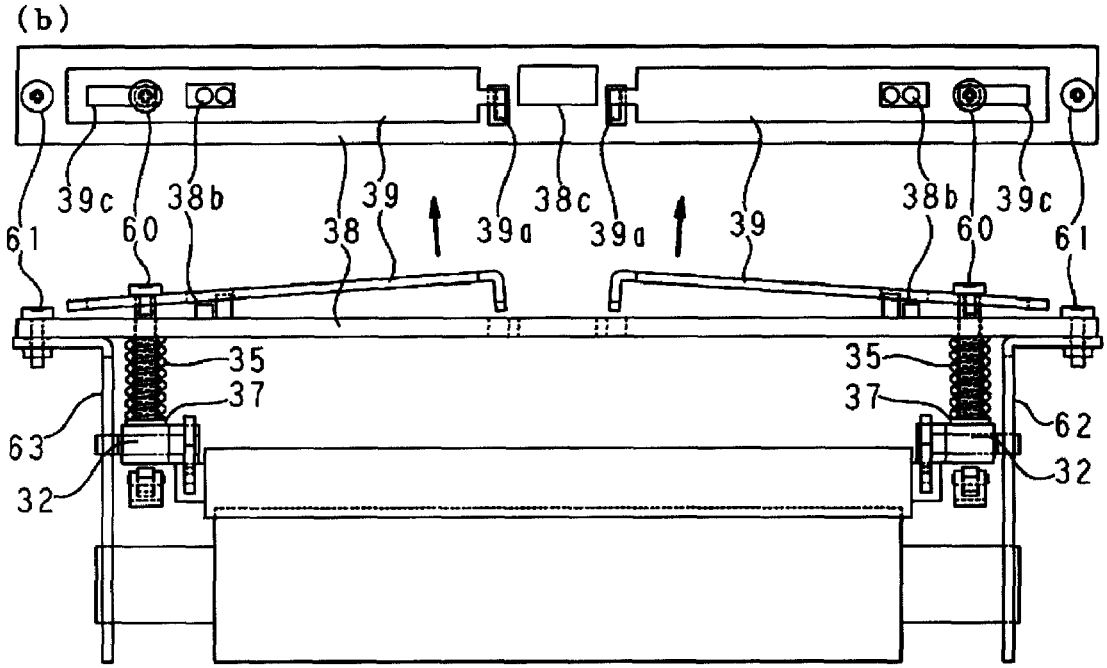
FIG. 6B is an explanatory view of a pressure releasing method of external heating members in the state that the external heating members are brought into contact with a fixing roller in the fixing apparatus according to the first embodiment and an explanatory view illustrating the state that a pressure releasing arm is lifted.
Figure 6C:
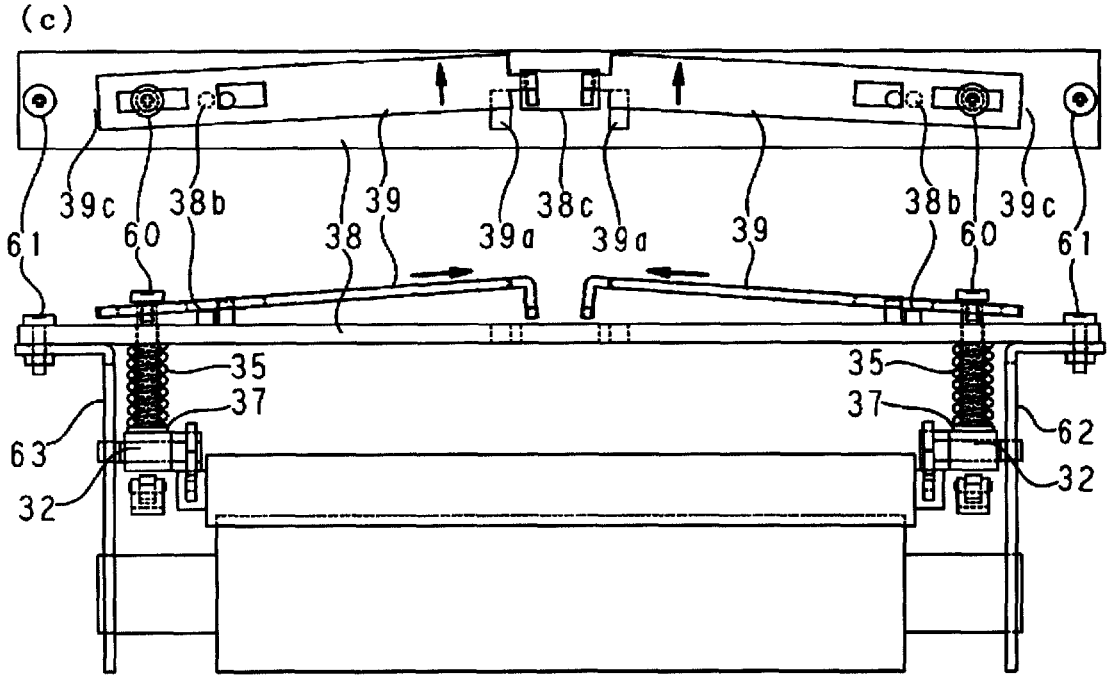
FIG. 6C is an explanatory view of a pressure releasing method of external heating members in the state that the external heating members are brought into contact with a fixing roller in the fixing apparatus according to the first embodiment and an explanatory view illustrating the state that a pressure releasing arm is slid.

When the pressure releasing arm 39 is lifted and its upper surface abuts the head of the screw 60 at the edge of the guide shaft 37, the slot 39*b* of the pressure releasing arm 39 passes out through the second supporting point member 38*b*. As illustrated in FIG. 6B, the pressure releasing arm 39 is lifted above the height L2 of the second supporting point member 38*b*. As illustrated in FIG. 6C, the pressure releasing arm 39 can be slid so as to be substantially parallel with a longitudinal direction. The first supporting point member 38*a* having the amount of protrusion larger than that of the second supporting point member 38*b* is in the range of the slot 39*b*. There is no trouble in slide of the pressure releasing arm 39.

Figure 6D:
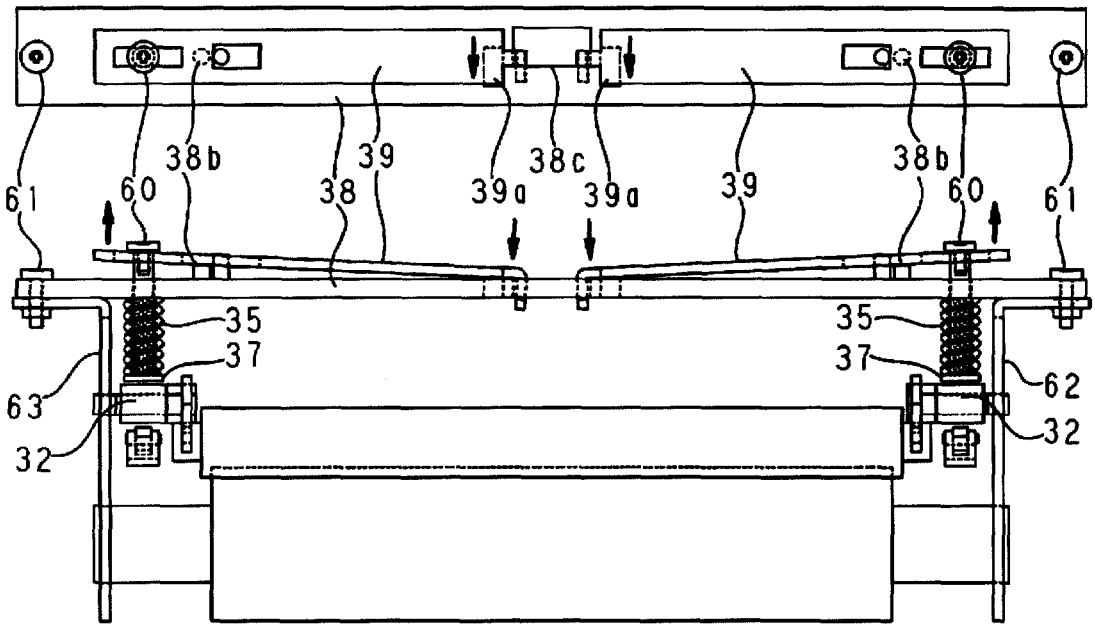
FIG. 6D is an explanatory view of a pressure releasing method of external heating members in the state that the external heating members are brought into contact with a fixing roller in the fixing apparatus according to the first embodiment and an explanatory view illustrating the state that a pressure releasing arm is operated to lift a pressure guide shaft.

As illustrated in FIG. 6C, the pressure releasing arm 39 is moved onto the second supporting point member 38*b*. As illustrated in FIG. 6D, the end portion of the engaging portion 39*a* is depressed. The second supporting point member 38*b* becomes the supporting member. The other end is lifted in the state that it abuts the screw 60. The guide shaft 37 is lifted. The engaging portion 39*a* of the pressure releasing arm 39 is hooked through the engaging hole portion 38*c* of the pressure stay 38 so as to hold the state that the guide shaft 37 is lifted. The distance between the second supporting point member 38*b* and the engaging portion 39*a* is sufficiently longer than the distance between the guide shaft 37 and the second supporting point member 38*b*. The operation for depressing the engaging portion 39*a* against the spring pressure can be easily performed without using any tools.

In this embodiment, the distance from the second supporting point member 38*b* to the acting portion 39*g* of the pressure releasing arm 39 is set to be 18 mm whereas the distance from the second supporting point member 38*b* to the engaging portion 39*a* is set to be 170 mm.

The pressure spring 35 is compressed. The lower surface of the guide shaft 37 is brought out of contact with the pressure arm 32. In this state, as in FIG. 5E, the screw 61 is loosened to detach the external heating unit.

The second supporting point member 38*b* has the amount of protrusion smaller than that of the first supporting point member 38*a*. When the engaging portion 39*a* is depressed using the second supporting point member 38*b* as the supporting point, the amount of lifting of the screw 60 at the other end is smaller than that when the first supporting point member 38*a* is used as the supporting point. When the end portion of the pressure guide shaft 37 is slightly brought out of contact with the pressure arm 32, the force of the pressure spring 35 does not act on the screw 61. The amount of slide of the pressure guide shaft 37 can be sufficient when the second supporting point member 38*b* having a small amount of protrusion is used as the supporting point.

When the pressure releasing arm 39 is operated, the end portion of the pressure guide shaft 37 need not be always brought out of contact with the pressure arm 32. When the amount of protrusion of the supporting point member is very small and the amount of slide of the pressure guide shaft 37 is very small at operation of the pressure releasing arm 39, the end portion of the pressure guide shaft 37 cannot be completely brought out of contact with the pressure arm 32 in engaging of the engaging portion 39*a* with the engaging hole portion 38*c*. When the pressure spring 35 is slightly compressed and its spring pressure is weakened to the degree that it hardly acts on the screw 61, the screw 61 can be easily unscrewed without causing screw galling.

The action of the pressure spring 35 on the screws 61 by operating the pressure releasing arm 39 to slide the pressure guide shaft 37 relative to the pressure stay 38 may be released, not only when the action of the spring pressure is completely lost, but also when it slightly remains (substantial release).

As described above, the use of the structure in this example can easily detach the external heating unit (urging unit) from the frame supporting the fixing roller (the first rotor) without causing any difficulties such as the damage of the screw. The maintenance operation can be easily performed.

Second Embodiment

A fixing apparatus according to a second embodiment will be described with reference to FIGS. 7A to 9. The fixing apparatus of this embodiment is the same as that of the first embodiment except for the pressure releasing mechanism of the external heating members. The description of the basic structure of the fixing apparatus and the structure which brings the external heating rollers into or out of contact with the fixing roller is omitted. Members having the same function as the above-described embodiment are indicated by like reference numerals.

The pressure releasing arm 39 of this embodiment is mounted on the upper portion of the guide shaft 37 so as to be rotatable on a camshaft 39*d*. Around the camshaft 39*d*, there are provided a cam portion 39*e* rotatable on the camshaft 39*d* and a lever portion 39*h* which rotates the cam portion 39*e* so as to be integral therewith.

Figure 7A:
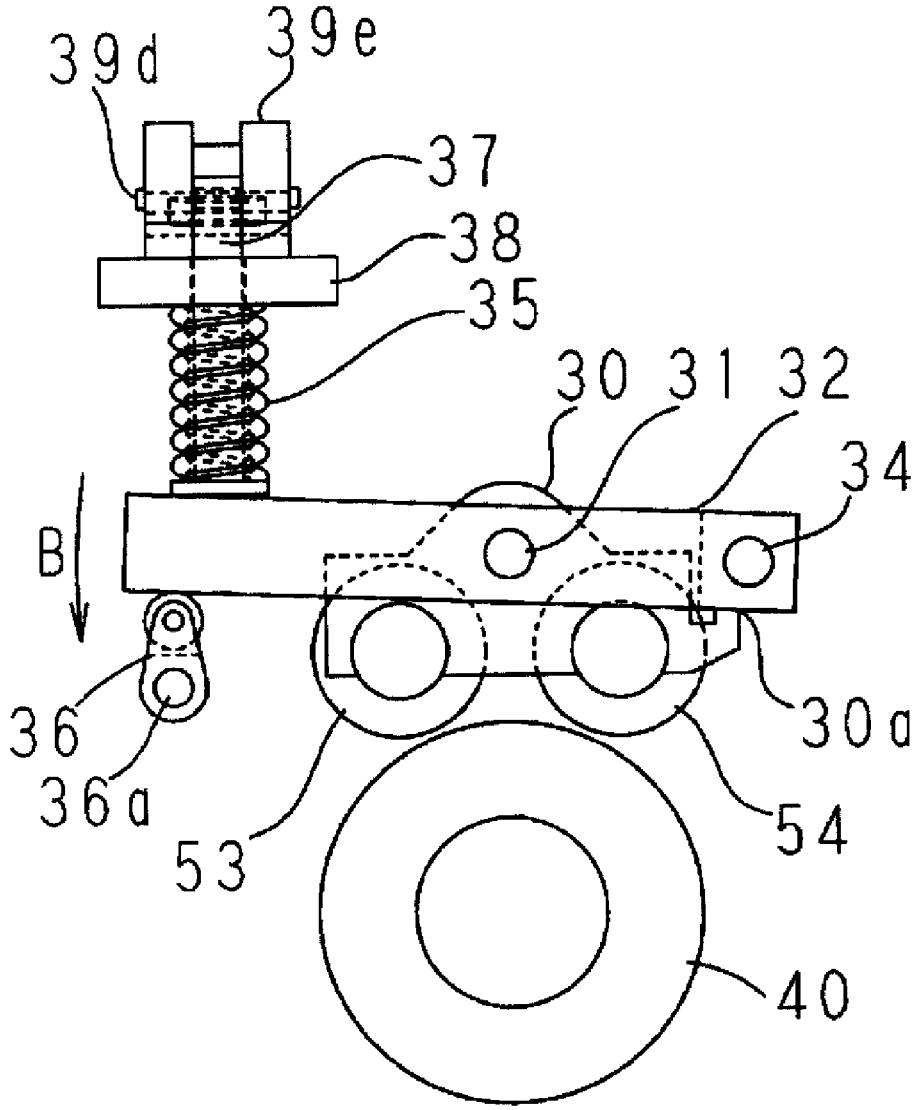
FIG. 7A is an explanatory view of the structure which brings external heating members into or out of contact with a fixing roller in the fixing apparatus according to a second embodiment and a cross-sectional view illustrating the state that the external heating members are brought out of contact with the fixing roller.
Figure 7B:
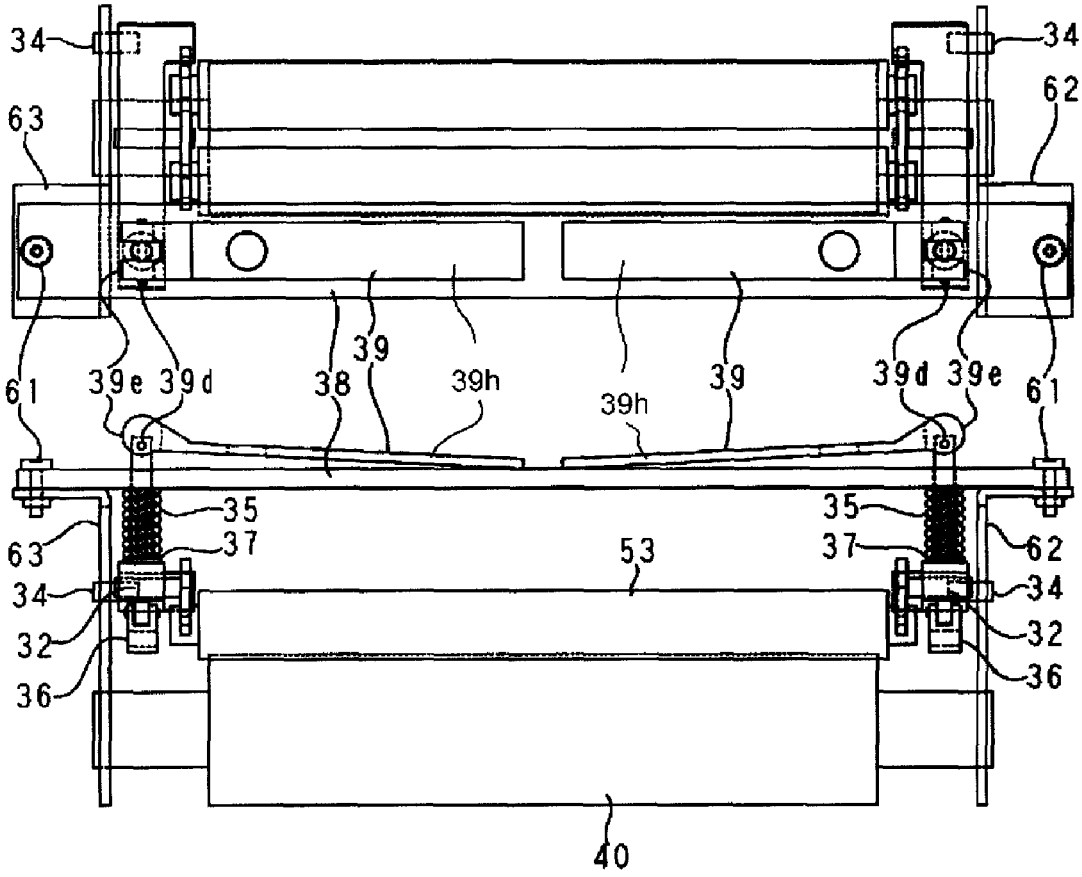
FIG. 7B is an explanatory view of the structure which brings external heating members into or out of contact with a fixing roller in the fixing apparatus according to the second embodiment and a top view and a front view illustrating the state that the external heating members are brought out of contact with the fixing roller.
Figure 8A:
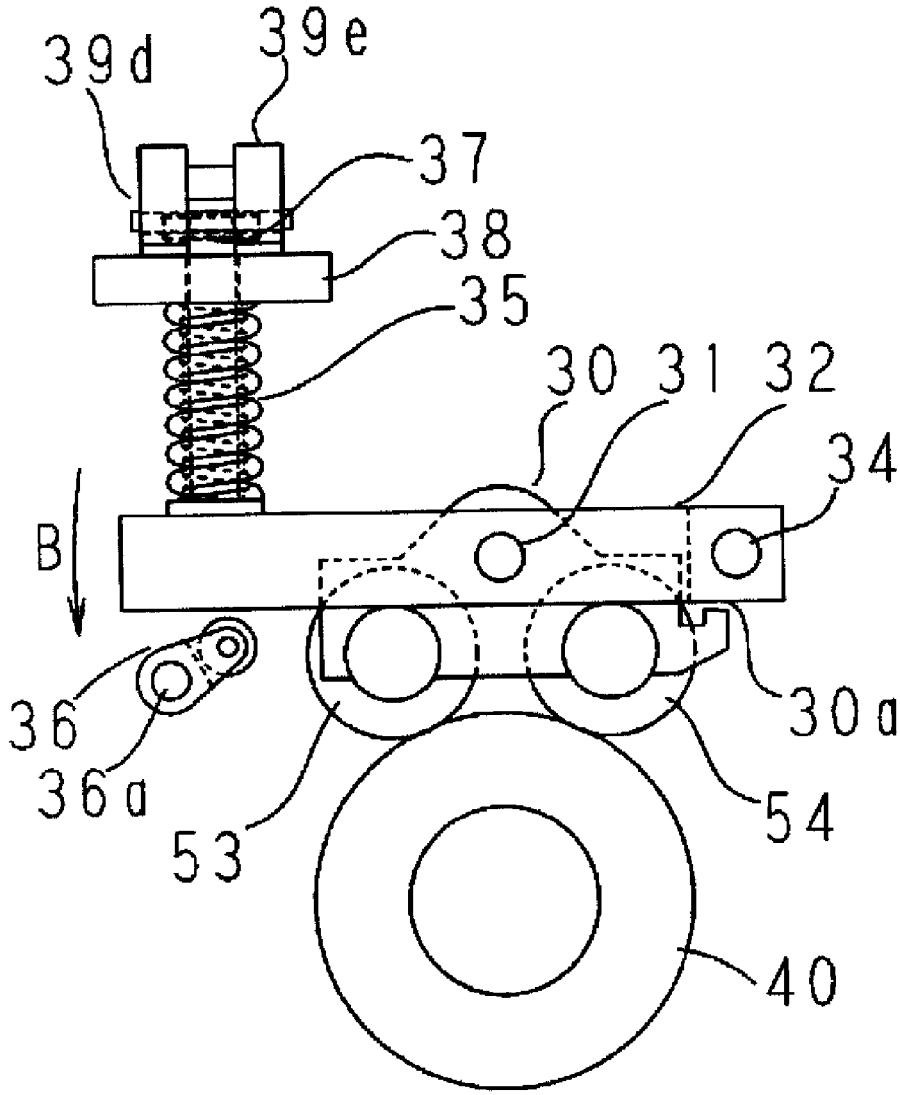
FIG. 8A is an explanatory view of the structure which brings external heating members into or out of contact with a fixing roller in the fixing apparatus according to the second embodiment and a cross-sectional view illustrating the state that the external heating members are brought into contact with the fixing roller.
Figure 8B:
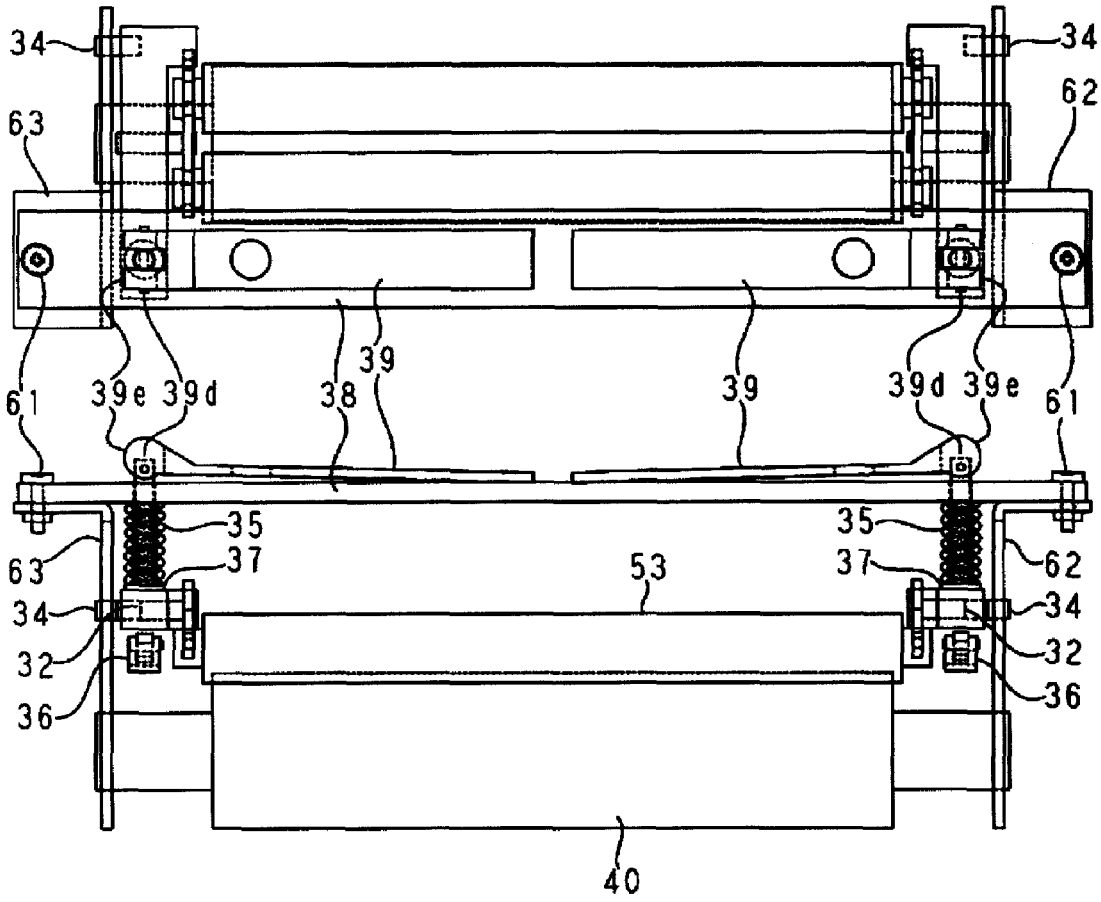
FIG. 8B is an explanatory view of the structure which brings external heating members into or out of contact with a fixing roller in the fixing apparatus according to the second embodiment and a top view and a front view illustrating the state that the external heating members are brought into contact with the fixing roller.

The cam portion 39*e* is eccentric relative to rotation center so as to have a portion which can press the external heating rollers 53 and 54 into contact with the fixing roller 40 at rotation and a portion which releases the force of the pressure spring 35 acting on the screw 61 via the pressure stay 38. FIGS. 7A and 7B illustrates the state that the external heating rollers as the external heating members are brought out of contact with the fixing roller. FIGS. 8A and 8B illustrates the state that the external heating rollers are pressed onto the fixing roller. In both cases, in the normal operation (image formation), the cam portion 39*e* is brought out of contact with the upper surface of the pressure stay 38 and the spring pressure of the pressure spring 35 is provided to the pressure arm 32 via the guide shaft 37.

Figure 9:
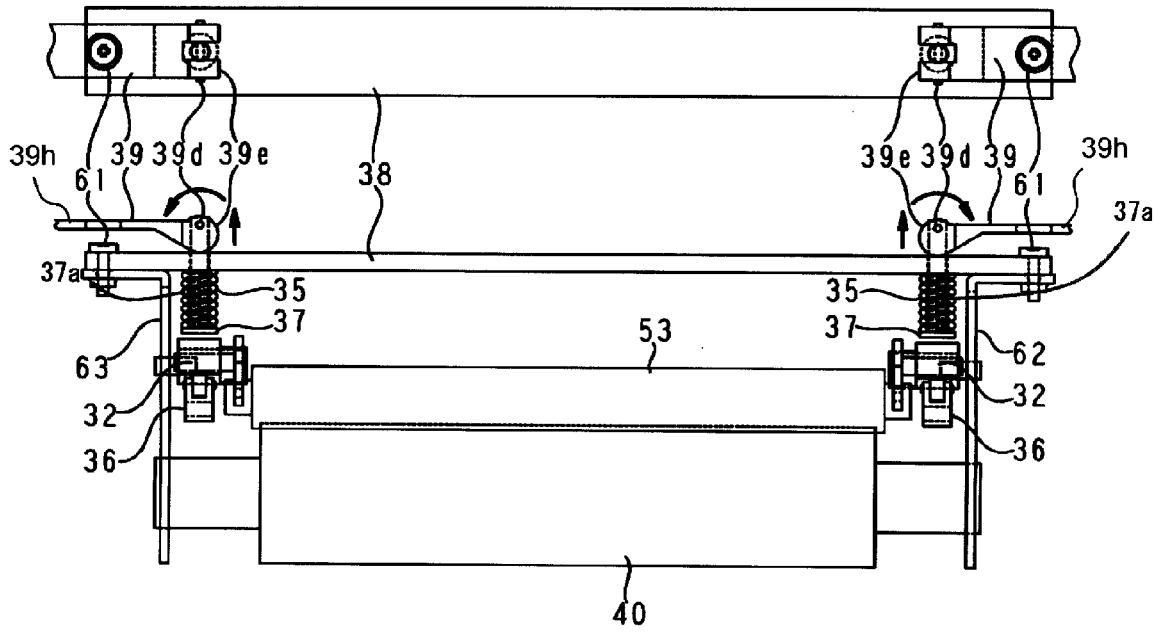
FIG. 9 is an explanatory view of a pressure releasing method of external heating members in the fixing apparatus according to the second embodiment.
Figure 10:
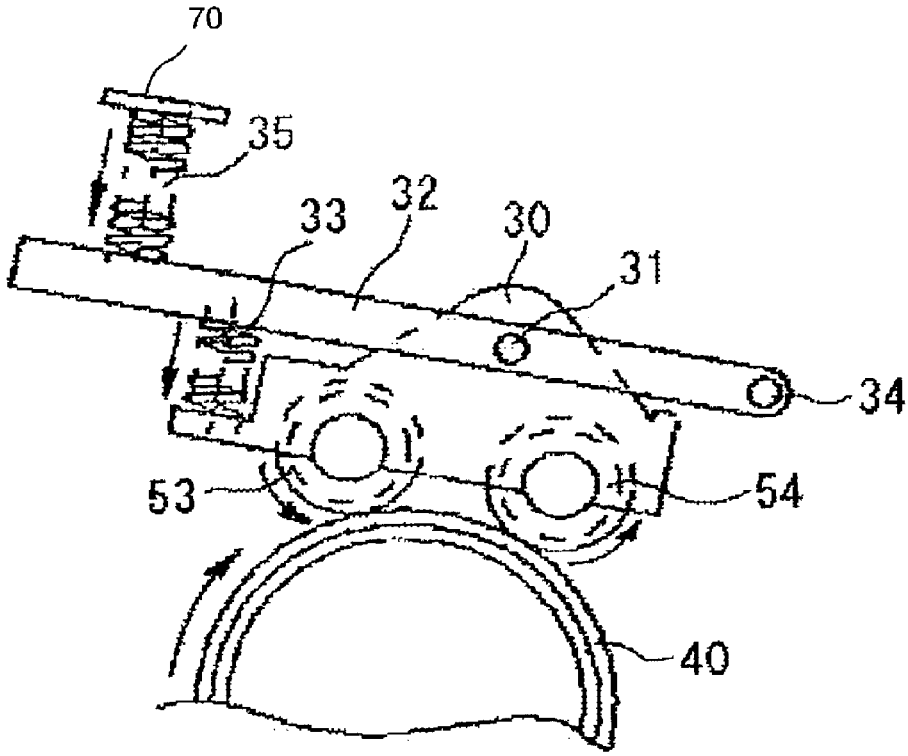
FIG. 10 is an explanatory view of a fixing apparatus having external heating members according to a related art.

As illustrated in FIG. 9, when the pressure releasing arm 39 is rotated on the camshaft 39*d*, the cam portion 39*e* abuts the upper surface of the pressure stay 38 to pull up the guide shaft 37. The pressure spring 35 is compressed. A pressure spring holding portion 37*a* provided on the lower surface of the guide shaft 37 is brought out of contact with the pressure arm 32. In this state, as in FIG. 5E, the screw 61 is loosened to detach the external heating unit.

As described above, the external heating unit under a large pressing force can be detached using the pressure releasing mechanism of a simple structure so as to form nips in which the external heating rollers can supply a sufficient amount of heat to the fixing roller. The external heating unit can be easily attached and detached without any special tools.

Third Embodiment

In the first embodiment, the screw 60 is screwed to the upper end of the pressure guide shaft 37 which holds the pressure spring 35, and the screw 60 is lifted by the pressure releasing arm 39 to slide the pressure guide shaft 37 for compressing the pressure spring 35.

In the second embodiment, the pressure releasing arm 39 mounted on the upper portion of the pressure guide shaft 37 which holds the pressure spring 35 so as to be rotatable on the camshaft 39*d*, and the camshaft 39*d* is lifted to slide the pressure guide shaft 37 for compressing the pressure spring 35.

The pressure spring 35 need not be always held by the pressure guide shaft 37.

One end of the pressure spring 35 is engaged with the pressure stay 38. The other end of the pressure spring 35 is engaged with the pressure arm 32. The urging force of the pressure arm 32 acts between both. When the pressure releasing arm 39 is operated, the pressure arm 32 is lifted to compress the pressure spring 35. The force of the pressure spring 35 acting on the screw 61 when the pressure releasing arm 39 is operated can be released.

In the above structure, as in the embodiments, the pressure spring 35 need not be held by the pressure guide shaft 37.

In the above embodiments, as the example of the image heating apparatus, the fixing apparatus which fixes an unfixed toner image formed on a recording material is described. The application range is not limited to such example.

The present invention is applicable to an image heating apparatus such as a gloss improving apparatus which heats a toner image fixed onto a recording material to improve the glossiness of the image.

The embodiments to which the present invention is applicable are specifically described above. Needless to say, the structures described in the above embodiments can be appropriately changed into a well known structure within the scope of the ideas of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-111165, filed Apr. 20, 2007, which is hereby incorporated by reference herein in its entirety.

What is claimed is:

1. An image heating apparatus including a first rotational body and a second rotational body which sandwich and convey a recording material so as to heat an image formed on the recording material and an external heating member which comes into pressurized contact with the first rotational body and heating the first rotational body from the outside, the image heating apparatus comprising:

a frame body which supports the first rotational body;

a unit including an urging member which urges the external heating member to the first rotational body, a holding member which holds the urging member, and a supporting member which slidably supports the holding member in the urging direction of the urging member;

a fastening member which detachably fastens the unit to the frame body via the supporting member; and a release unit which alleviates the urging force of the urging member by sliding the holding member with respect to the supporting member.

2. The image heating apparatus according to claim 1, wherein the release unit moves the holding member away from the external heating member.

3. The image heating apparatus according to claim 1 or 2, wherein the urging member includes a compression spring, and the release unit compresses the compression spring by sliding the holding member with respect to the supporting member.

4. The image heating apparatus according to claim 1 or 2, wherein the release unit includes an arm member adapted to rotate about a supporting portion, wherein the arm member includes an action portion which acts on the holding member and a hook portion capable of engaging with the supporting member so that the holding member maintains a slid state with respect to the supporting member, and wherein a distance between the supporting portion and the action portion is longer than a distance between the supporting portion and the hook portion.

5. The image heating apparatus according to claim 4 further comprising a contacting/separating unit which brings to the external heating member into contact with the first rotational body or separates the external heating member away from the first rotational body, wherein a first supporting portion and a second supporting portion are arranged on the supporting member as the supporting portion, wherein the first supporting portion is used when the external heating member is away from the first rotational body, and wherein the second supporting portion has a smaller amount of protrusion than the first supporting portion and is used when the external heating member is in contact with the first rotational body.

6. The image heating apparatus according to claim 5, wherein the supporting member is formed with a hole portion into which the hook portion can be inserted so that an arm portion of the arm member is substantially in parallel with the supporting member during non-released time.

7. The image heating apparatus according to claim 1 or 2, wherein the release unit includes a cam portion rotatably arranged on the holding member and a lever portion which rotates this cam portion, and wherein the cam portion includes a section enabling the external heating member to coming into pressurized contact with the first rotational body and a section which releases the force exerted by the urging member on the fastening member via the supporting member.

8. The image heating apparatus according to claim 1 or 2, wherein the fastening member has a male screw which fastens the supporting member to the frame body.

* * * * *